US011950643B2

(12) United States Patent
Robarts et al.

(10) Patent No.: US 11,950,643 B2
(45) Date of Patent: Apr. 9, 2024

(54) COOLING APPARATUS

(71) Applicants: Jason Robarts, Simi Valley, CA (US); Paul Koch, Simi Valley, CA (US)

(72) Inventors: Jason Robarts, Simi Valley, CA (US); Paul Koch, Simi Valley, CA (US)

( * ) Notice: Subject to any disclaimer, the term of this patent is extended or adjusted under 35 U.S.C. 154(b) by 0 days.

(21) Appl. No.: 16/422,964

(22) Filed: May 25, 2019

(65) Prior Publication Data

US 2020/0367581 A1 Nov. 26, 2020

(51) Int. Cl.

| | |
|---|---|
| ***A41D 13/005*** | (2006.01) |
| *A41D 13/00* | (2006.01) |
| *A41D 31/14* | (2019.01) |
| *F41H 1/02* | (2006.01) |

(52) U.S. Cl.

CPC ..... *A41D 13/0053* (2013.01); *A41D 13/00* (2013.01); *A41D 13/0058* (2013.01); *A41D 31/14* (2019.02); *A41D 31/145* (2019.02); *F41H 1/02* (2013.01)

(58) Field of Classification Search

CPC ..... A41D 13/0053; A41D 13/0058; A41D 13/00; A41D 31/14; A41D 31/145; F41H 1/02

USPC ..... 2/69

See application file for complete search history.

(56) References Cited

U.S. PATENT DOCUMENTS 3,079,765 A * 3/1963 Le Vantine ..... B64G 6/00 62/259.3
3,279,201 A * 10/1966 Wortz ..... A41D 13/0053 62/62
3,291,126 A * 12/1966 Messick ..... A41D 13/0053 128/201.29
3,468,299 A * 9/1969 Amato ..... A41D 13/0025 126/204
3,670,518 A * 6/1972 Esposito ..... A61F 7/10 62/167
3,736,764 A * 6/1973 Chambers ..... A41D 13/0053 62/89

(Continued)

*Primary Examiner* — Khaled Annis
*Assistant Examiner* — Dakota Marin
(74) *Attorney, Agent, or Firm* — Foundation Law Group LLP; J D Harriman

(57) ABSTRACT

The system comprises a cooling garment that is intended to cool the user of the garment. In one embodiment, the cooling garment is worn under a body armor. In one embodiment, the cooling garment is worn under any other garment or in any situation or environment where the user desires a cooling effect. In one embodiment the cooling garment comprises an outer layer and an inner layer. The inner layer has a plurality of perforations that allow air to flow therethrough. The outer layer is solid, so that air is urged toward the perforations and does not exit the garment away from the user, but instead towards the user. A flexible hose is coupled between the first and second layer and extends outward from the garment. The hose terminates in a quick release coupling that allows it to be removably attached to an air source, such as from a pump or other cooling system. In one embodiment, the quick release coupling is magnetic and is detached by pulling on the coupling or by the user of the cooling garment stepping away from the connection. In one embodiment, the system is used in a vehicle with a pump coupled to the electrical system of the vehicle.

6 Claims, 6 Drawing Sheets

(56) References Cited

U.S. PATENT DOCUMENTS 4,118,946 A * 10/1978 Tubin ..... F25B 19/00 165/46
4,738,119 A * 4/1988 Zafred ..... A41D 13/0053 2/81
4,914,752 A * 4/1990 Hinson ..... A41D 13/0025 2/457
5,438,707 A * 8/1995 Horn ..... A41D 13/0053 2/457
5,533,354 A * 7/1996 Pirkle ..... A41D 13/0053 2/458
5,970,519 A * 10/1999 Weber ..... A41D 13/0025 2/102
6,128,784 A * 10/2000 Frank ..... A41D 27/28 2/102
6,260,201 B1 * 7/2001 Rankin ..... A41D 13/0025 2/272
6,272,877 B1 * 8/2001 Halloran ..... A41D 13/0053 62/259.3
6,584,798 B2 * 7/2003 Schegerin ..... A41D 13/0053 62/259.3
6,901,769 B2 * 6/2005 Blackstone ..... F24F 5/0017 62/421
7,018,366 B2 * 3/2006 Easter ..... A61F 5/451 604/327
7,117,687 B2 * 10/2006 Naaman ..... A41D 31/065 62/259.3
7,266,965 B2 * 9/2007 Blackstone ..... A41D 13/0025 62/259.3
7,565,705 B2 * 7/2009 Elkins ..... A41D 13/0053 2/102
7,716,940 B2 * 5/2010 Farnworth ..... A62B 17/005 62/259.3
8,082,596 B2 * 12/2011 Pohr ..... A41D 13/0025 2/97
8,302,421 B2 * 11/2012 Korytnikov ..... F24F 5/0035 62/314
8,443,463 B2 * 5/2013 Paull ..... A41D 13/0053 2/69
9,188,398 B2 * 11/2015 Freeman ..... F28D 15/04
9,220,306 B2 * 12/2015 Majoros ..... A41D 27/02
10,264,830 B2 * 4/2019 Ichigaya ..... A41D 1/002
10,619,913 B2 * 4/2020 Grant ..... A41D 13/00
2003/0167559 A1 * 9/2003 How ..... A41D 13/0053 2/458
2003/0196254 A1 * 10/2003 Forgach ..... A41D 13/0025 2/411
2004/0079517 A1 * 4/2004 Bueley ..... F28D 1/0477 165/46
2005/0143796 A1 * 6/2005 Augustine ..... A41D 13/0025 607/104
2005/0246826 A1 * 11/2005 McCarter ..... A41D 13/0053 2/458
2007/0000008 A1 * 1/2007 Sawicki ..... A41D 13/0025 2/69
2008/0141428 A1 * 6/2008 Kapah ..... A41D 13/0025 2/2.5
2008/0289077 A1 * 11/2008 Enlund ..... A41D 13/0053 2/81
2010/0223943 A1 * 9/2010 Loukaides ..... A41D 13/0053 62/259.3
2010/0319381 A1 * 12/2010 Hubler ..... F28D 5/00 62/259.3
2011/0087143 A1 * 4/2011 Bobey ..... A61H 9/0078 601/152
2012/0151951 A1 * 6/2012 Terry ..... A61F 7/02 62/259.3
2012/0227432 A1 * 9/2012 Creech ..... A41D 13/0053 62/259.3
2012/0260398 A1 * 10/2012 Stapleton ..... A41D 13/0053 2/102
2014/0201891 A1 * 7/2014 Turner ..... A41D 31/14 2/455
2015/0150313 A1 * 6/2015 Huckins ..... A41D 13/0056 62/259.3
2015/0313294 A1 * 11/2015 Yue ..... A41D 13/0025 2/69
2016/0361196 A1 * 12/2016 Spence ..... A41D 13/005
2018/0070659 A1 * 3/2018 Xu ..... A41D 13/0053
2018/0128577 A1 * 5/2018 Beck ..... F41H 5/0478
2018/0213855 A1 * 8/2018 Beyeler ..... B32B 3/20
2018/0317572 A1 * 11/2018 Guttman ..... A41D 13/005
2019/0008219 A1 * 1/2019 Davidovits ..... F04D 29/522
2020/0046041 A1 * 2/2020 Woods ..... F41H 1/02
2020/0054080 A1 * 2/2020 Luo ..... A41D 13/0053

* cited by examiner

COOLING APPARATUS

BACKGROUND OF THE SYSTEM

First responders and military personnel often are required to wear body armor as protection. The term "body armor" is often used interchangeably with bullet proof vest" and other terms (e.g. tactical vest, ballistic garment, and the like). In fact, there are various kinds of body armor for different threats, including ballistic (e.g. bullets), edged weapon protection, spike protection, multi-threat, and the like. In this description, the term body armor is intended to refer to all types of body armor.

Wearing body armor in warm weather leads to the user typically being very warm in the armor. There is little or no ventilation in the armor so the user may sweat uncomfortably in the armor during use.

There is a desire to make the armor more comfortable when worn, particularly to provide ventilation and or cooling to the user during use. There have been a number of attempts to provide cooling for body armor in the current art. One attempt has been the use of a mesh garment to be worn under the armor to provide ventilation and airflow. However, the mesh garment is passive and does not provide actual cooling or active airflow for the user.

Another prior art attempt is a garment that is soaked in cold water for a few minutes before use. The evaporation of the water in the material is intended to provide a cooling effect for the user. However, most users do not want to put wet garments on and it is not effective without re-soaking the garment, which is not always possible to do.

Another attempt is a hose with a "U-shaped" nozzle that is inserted into the neck of the armor, with another end positioned over an air-conditioning vent of a vehicle. A disadvantage of this system is that any cooling air is directed in only a single location of the body, and the system is not efficient in capturing cool air from many typical air conditioning vents. It does not provide cooling to the lower torso, shoulders, or back area.

SUMMARY

The system comprises a cooling garment that is intended to cool the user of the garment. In one embodiment, the cooling garment is worn under a body armor. In one embodiment, the cooling garment is worn under any other garment or in any situation or environment where the user desires a cooling effect. In one embodiment the cooling garment comprises an outer layer and an inner layer. The inner layer has a plurality of perforations that allow air to flow therethrough. The outer layer is solid, so that air is urged toward the perforations and does not exit the garment away from the user, but instead towards the user. A flexible hose is coupled between the first and second layer and extends outward from the garment. The hose terminates in a quick release coupling that allows it to be removably attached to an air source, such as from a pump or other cooling system. In one embodiment, the quick release coupling is magnetic and is detached by pulling on the coupling or by the user of the cooling garment stepping away from the connection. In one embodiment, the system is used in a vehicle with a pump coupled to the electrical system of the vehicle. In one embodiment, the system is used with a battery operated pump.

DETAILED DESCRIPTION OF THE SYSTEM

Figure 1:
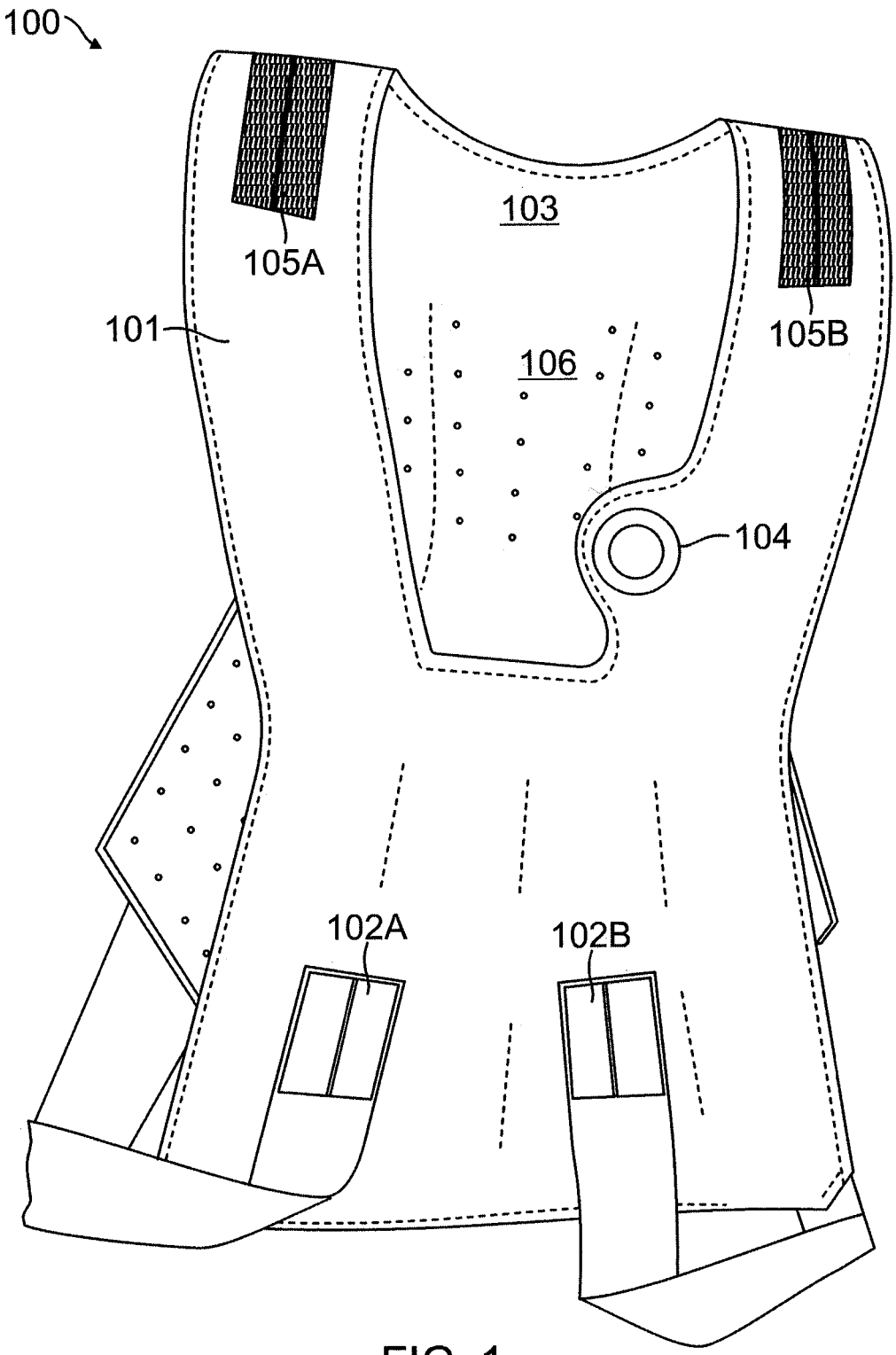
FIG. 1 is a front view of a cooling garment in an embodiment of the system.

The system provides a cooling garment that can be coupled to an air source and easily decoupled and recoupled as desired. The cooling garment provides consistent ventilation over the inner surface of the garment, keeping the user cool and dry over a variety of environmental conditions. FIG. 1 is a front view of a cooling garment in an embodiment of the system. The garment 100 in this embodiment is a tunic style garment that has a large opening so that it can be pulled on over the head. The garment 100 includes a front layer 101 and rear layer 103. The layers are coupled together so that there is a gap (not shown) between the layers 101 and 103 to allow air flow.

The garment 100 includes straps 102A and 102B for securing the Garment to a tactical vest or to a cover of a tactical vest. The straps are one type of Velcro and there are regions on a vest cover an/or on the tactical vest (e.g. hooks and loops) so that the garment can be secured to the vest cover or vest. Shoulder Velcro™ regions 105A and 106A are provided so that a body armor with corresponding Velcro™ regions inside the shoulder area can secure to the garment 100, helping to keep it in place.

Vest makers provide a cover that goes over and holds the actual ballistic body armor material used for protection. In one embodiment, the garment of the system contains a separate large pocket on the outside of the front and back panels so the actual ballistic panels can slide in and would ultimately be contained on the cooling garment. In one embodiment, the cooling system can be stitched, attached or integrated by other means to the inside of an existing vest cover so that again, all is contained in one wearable integrated system.

The rear layer 103 includes a plurality of perforations 106 that allow air to be introduced to the user when the garment is worn. The gap between the front layer 101 and rear layer 103 expands somewhat as air is introduced to that region, permitting greater airflow via the perforations. A coupling 104 is used to couple a hose to the garment. The hose is coupled to an air source such as an air pump and introduces flowing air to the garment 100. The garment may include channels defined in the gap to direct more airflow to the regions with the perforations in an embodiment of the system.

In one embodiment the coupling 104 is an "O" shaped ring that is magnetic and has an opening in the middle through which air is introduced. The magnetic ring engages a corresponding magnetic ring on the hose to hold the hose securely in place without the need for clips or locks. This magnetic coupling makes it easier to couple and uncouple the hose quickly, in case the user needs to move quickly and to separate from the hose. In the embodiment shown, the coupling is placed near the chest area of the garment. In one embodiment, the coupling 104 is placed on the front or rear shoulder strap of the garment. The coupling 104 may be placed wherever convenient for use and access. In one embodiment the coupling is placed near the collar or neck region so that the user can unbutton the uniform to allow access to the coupling.

Figure 2:
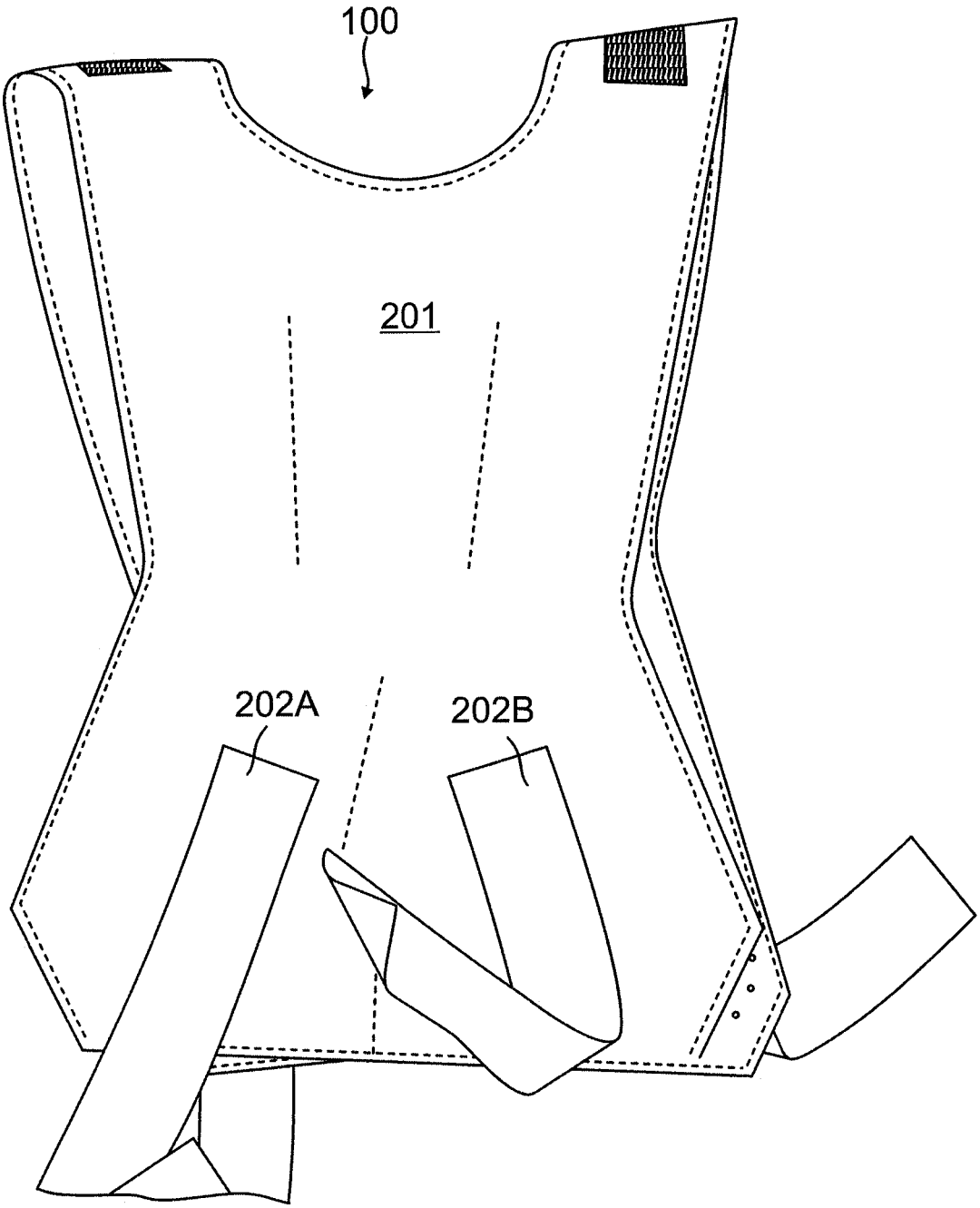
FIG. 2 is a rear view of the cooling garment of FIG. 1.

FIG. 2 is a rear view of garment 100 and illustrates the back surface 201 with adjusting straps 202A and 202B to secure to a vest or vest cover. Although shown as a tunic style garment, the garment may be of any suitable style as desired. The shoulders of the garment may be tapered in one embodiment as desired.

Figure 3:
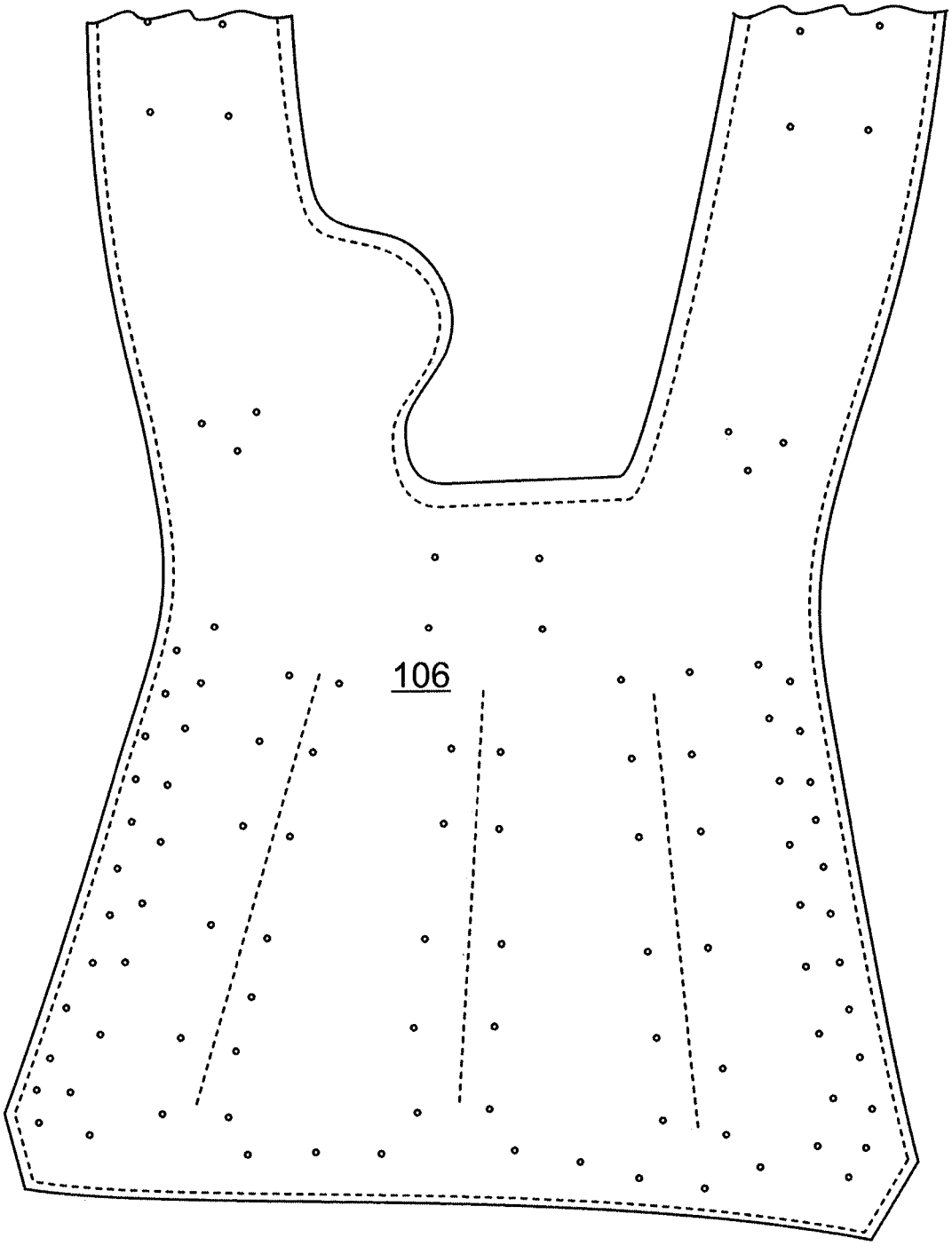
FIG. 3 is a view of the inner front surface of the cooling garment of FIG. 1.
Figure 4:
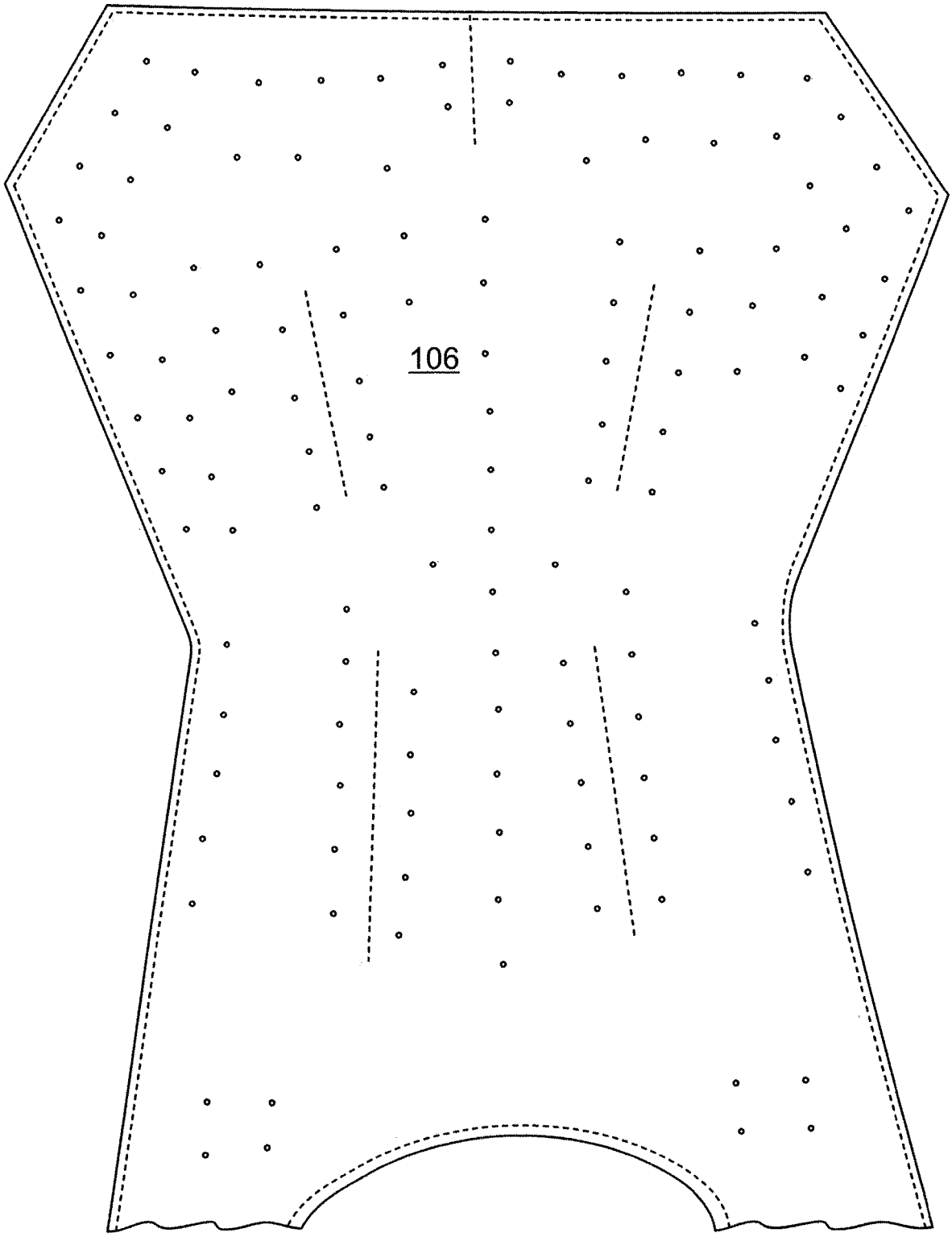
FIG. 4 is a view of the inner rear surface of the cooling garment of FIG. 1.

FIG. 3 illustrates the inner surface 301 of the front layer 101 of the garment 100. The inner surface 301 includes a plurality of perforations 106 that provide airflow via the coupling 104 from the front side. In one embodiment, the front layer 101 and rear layer 103 may be coupled only on the outside edge, so that there is one large pocket formed by the two layers. The front layer 101 and the rear layer 103 form a sleeveless tunic having open sides. In one embodiment, there are channels formed within the gap between the layers by sewing, gluing, and the like, to direct the airflow through the channels to the perforations. The perforations may be formed in a pattern and distributed evenly over the inner surface, or they may be in rows and/or columns to define areas of airflow on the user. FIG. 4 illustrates the inner surface 103 of the rear portion of the garment 100 and the perforations 106.

Figure 5:
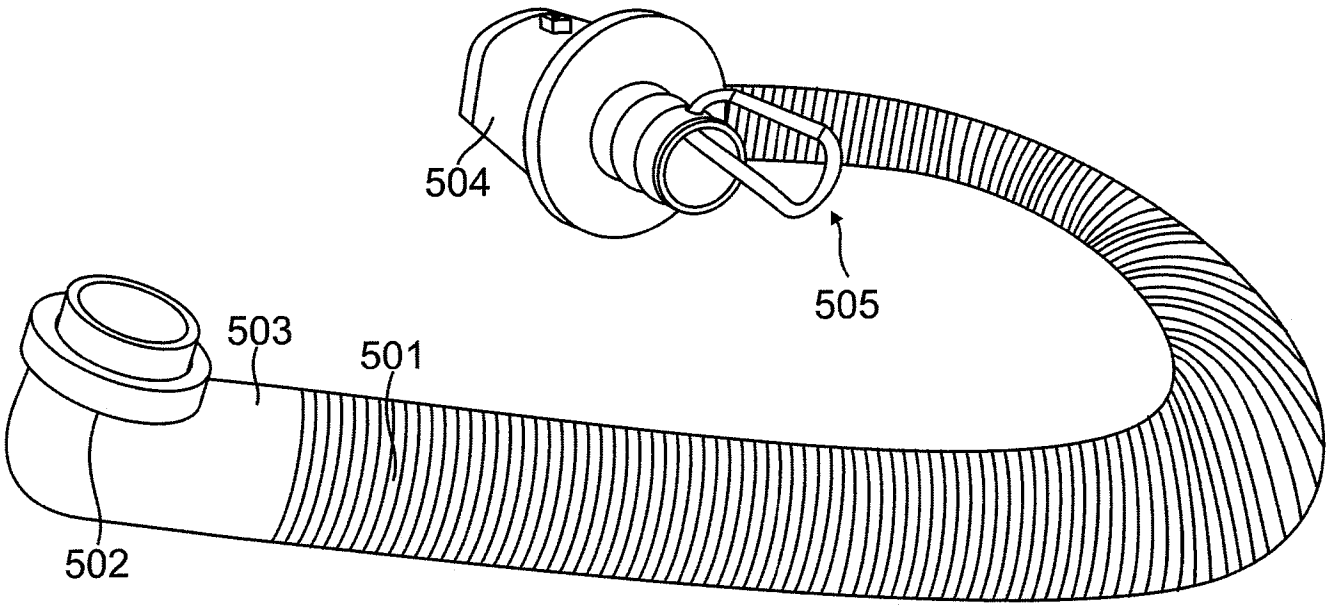
FIG. 5 illustrates a hose, coupling, and pump in an embodiment of the system.

FIG. 5 illustrates a hose and pump assembly in an embodiment of the system. A hose (e.g. flex hose) 501 is coupled to a pump 504. The pump 504 may be any suitable pump that can pump air into the hose at an acceptable rate. In one embodiment the pump 504 is powered by an adapter plugged into a cigarette lighter socket in a vehicle. In one embodiment, the pump may be coupled to the vehicle electrical system in some other manner. The pump 504 may be designed so that when the vehicle power is on, the pump automatically turns on as well. Correspondingly, when the vehicle power is turned off, the pump is turned off. In one embodiment, the pump may have a separate on/off switch that can be activated by the user. In one embodiment, the pump may be operated via a remote control for more ease of use. Examples of suitable pumps include pumps used to inflate pool toys, rafts, air mattresses, and the like. In one embodiment, the pump may have an integrated magnet that can be used to secure the pump to a metal and/or magnetic connection point between the front seats of a vehicle. This prevents the pump from moving around and affecting its efficiency. In one embodiment the pump includes a clip 505 that can be used to secure the pump at some convenient location in a vehicle. In one embodiment the pump is battery powered and can be used outside of a vehicle if desired.

The hose 501 includes a right-angled nozzle 502 for engaging the coupling 104 of the garment 100. The end 502 includes hose coupling ring 503. The hose coupling ring 503 engages the coupling ring 104 of the garment 100 to secure the hose in place so that air flow is maximized into the garment 100. In one embodiment, both the coupler 104 and the hose coupling ring 503 are magnetic. In one embodiment, one of the coupling ring 104 and the hose coupling ring 503 is magnetic while the other is metallic. The strength of the magnetic connection should be such that the hose remains securely in place during use but can be easily disconnected by hand if the user needs to quickly disengage the cooling garment system.

In one embodiment, the nozzle end 502 can be rotated 360 degrees in place so that the user can find the angle that best attaches to the vest to prevent movement of the pump. The nozzle end 502 can be a right angle, a swivel connection, a ball-joint connection, or other connection to allow flexibility in coupling the hose to the garment. In one embodiment, the hose may be a retractable hose that is retracted when not in use.

In one embodiment, the one or both ends of the hose can be connected with a pressure fit that secures the hose in place but can be overcome with reasonable force to allow the user to disengage the hose by normal movement that occurs when exiting a vehicle.

Although the garment 100 is shown with the coupling ring 104 flush with the surface of the garment 100, the system may be practiced in other variations. For example, the garment 100 could have a short length of hose extending from some location on the garment with the coupling 104 at the end of that short length of hose. The short hose can then engage the pump hose 501 outside the boundaries of the garment 100.

In one embodiment the short hose extends from a shoulder of the garment 100 to reduce interference with the device when sitting in a vehicle.

Figure 6:
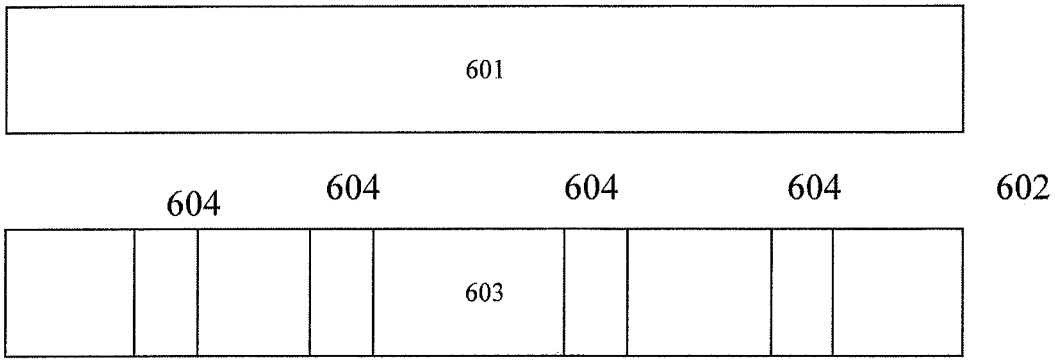
FIG. 6 illustrates a cross sectional view of the garment 100.

FIG. 6 is a cross sectional view of an embodiment of the garment. Upper layer 601 is comprised of a fabric such as stain-proof, water-proof, polyester with a plastic backing, and/or canvas, cotton, and the like. There is a gap 602 between the upper layer 601 and the bottom layer 603. Gap 602 permits the flow of air throughout the interior of the garment when in use and is devoided of other material. Bottom layer 603 includes a plurality of perforations 604 that allow air to flow from gap 602 to impinge on the user. In one embodiment, bottom layer 603 is comprised of a "ripstop" plastic material which can be found in parachutes and canopies. However, any suitable material can be used that allows airflow to the body. In one embodiment, the bottom layer is approximately 3 mils in thickness.

In one embodiment, the garment may include a spacer (e.g. foam, plastic, and the like) in the shoulder region to allow airflow to the back of the garment, and so that region does not pinch off the airflow when worn. In one embodiment, a series of hoses with perforations can be located in the gap region to deliver air to the user. In on embodiment, the bottom layer may or may not have perforations of its own, but is such that air can flow through the material of the bottom layer.

What is claimed is:

1. A garment comprising:

a first layer comprising a first material and having a front side and a back side and a first outside edge;

a second layer comprising a second material and having a second outside edge;

the first and second layer coupled together only on the first and second outside edge such that a single interior space, devoided of material, is defined therebetween, thereby permitting flow of air throughout the entire interior space of the garment, and wherein the first and second layer form a sleeveless tunic having open sides;

the second layer having a plurality of perforations formed therein;

the first layer including a first coupling on the front near a neck area of the garment;

a pump having an air hose wherein the air hose has a second coupling at an end of the air hose;

the hose being attached to the first coupling via the second coupling.

2. The garment of claim 1 wherein the first coupling and the second coupling are magnetic.

3. The garment of claim 1 wherein the first coupling is attached to the second coupling by a pressure fit.

4. The garment of claim 1 wherein the pump is battery operated.

5. The garment of claim 1 wherein the garment includes fastening means to secure the garment.

6. The garment of claim 1 wherein the first and second layers have no bumps or protrusions in the interior space.

* * * * *